US006336607B1

(12) United States Patent
Perrier

(10) Patent No.: US 6,336,607 B1
(45) Date of Patent: Jan. 8, 2002

(54) KITE LINE REELER AND CONTROLLER

(76) Inventor: Eugene L. Perrier, 361 NW. 45th Ter., Plantation, FL (US) 33317

( * ) Notice: Subject to any disclaimer, the term of this patent is extended or adjusted under 35 U.S.C. 154(b) by 0 days.

(21) Appl. No.: 09/677,748

(22) Filed: Oct. 3, 2000

(51) Int. Cl.[7] ..... B65H 75/40; B65C 31/06

(52) U.S. Cl. ..... 242/388.6; 242/395.1; 242/396.4; 242/396.9; 242/405.3; 244/155 A

(58) Field of Search ..... 242/388.6, 395, 242/395.1, 396.4, 396.9, 405.3; 244/155 A

(56) References Cited

U.S. PATENT DOCUMENTS

| | | | | |
|---|---|---|---|---|
| 2,388,478 A | * 11/1945 | Garber | | 244/155 A |
| 3,086,739 A | 4/1963 | Barber | | 244/155 A |
| 3,409,255 A | 11/1968 | Sada | | 244/155 A |
| 3,740,010 A | 6/1973 | Curtis | | 244/155 A |
| 3,807,672 A | 4/1974 | Williams | | 244/155 A |
| 4,129,273 A | 12/1978 | Hill | | 244/155 A |
| 4,176,807 A | 12/1979 | Kwon | | |
| 4,334,380 A | * 6/1982 | Daniels | | 242/388.8 |
| 4,653,702 A | 3/1987 | McGinnis | | |
| 4,796,827 A | 1/1989 | Munt | | |
| 4,821,976 A | 4/1989 | Nakashima | | |
| 4,981,271 A | 1/1991 | Carter | | |
| 5,071,085 A | 12/1991 | Beers | | |
| 5,180,123 A | 1/1993 | Lin | | 244/155 A |
| 6,230,724 B1 * | 5/2001 | Lal | | 242/395 |

* cited by examiner

*Primary Examiner*—John M. Jillions
(74) *Attorney, Agent, or Firm*—Alvin S. Blum

(57) ABSTRACT

An apparatus for controlling a plurality of lines to a light weight flying device such as a kite or model airplane stores, winds up, and releases the lines on individual, separable spools. The spools are held in a recess in a housing. Each line leads from its spool through spaced apart individual line guides to the device so that the device may be controlled by manipulation of the housing. A winding handle is mounted on an arm connected to an axle on which the spools are rotatably mounted in the recess. In a first, or winding, position of the arm, rotation of the handle rotates the axle and the spools for winding up the lines. An anti reverse ratchet mechanism prevents unwinding of the lines. In a second, or release, position of the arm, the spools are freed from rotation with the axle, an adjustable drag is operative to prevent free spooling or backlash, and the anti reverse is releasable by a manual control for controllably releasing the lines.

11 Claims, 4 Drawing Sheets

KITE LINE REELER AND CONTROLLER

BACKGROUND OF THE INVENTION

This invention relates to controllers for light weight airborne devices such as kites, model airplanes, and the like, and more particularly, to apparatus for storing and releasing a plurality of lines to such devices on spools and means for controlling tension on the individual lines to control flight of the devices.

DESCRIPTION OF THE PRIOR ART

When flying a kite, the simplest control is a single line on a spool. For better control, and for manipulation of more sophisticated kites such as stunt kites, three lines attached at different sites on the kite enable the operator to turn the kite and change its attitude. Kite line winders and controllers are well known, as exemplified by U.S. Pat. No. 3,740,010 issued to Curtis is for two lines. A single spool has grooves for receiving two lines. The lines pass through spaced-apart guides to enable turns to be made by simply twisting the device. A frictional drag is mounted in a groove between the two line grooves. No facility is provided for a third line or for disengaging the winding crank when not in use. U.S. Pat. No. 3,086,739 issued to Barber is for three or four lines that fit into separate grooves on a common spool. A winding handle always rotates with the spool. A brake is applied by manually applying pressure to a lever. It would be desirable to have a line winder and controller for multiple lines in which each line were on a separate spool, so that the lines could be easily replaced with fresh, untangled lines already on replacement spools. It would also be useful to have an adjustable drag to prevent backlash when releasing line, in which the drag could be preset and the crank did not rotate during line release. It would also be useful if the drag were disconnected and an anti reverse mechanism were operative during wind up.

SUMMARY OF THE INVENTION

It is accordingly an object of the invention to provide a line winder and controller for two or more lines in which each line is wound on a separate spool that can be easily replaced while all of the spools are rotated by a common crank that does not turn when line is being released. It is another object that the winder have a presettable drag that is disengaged during wind up.

The apparatus of the invention comprises a line winder and controller that winds each of a plurality of lines on separable spools that can be rotated together by a single handle. It includes a presettable drag that is engaged when line is being released to prevent backlash, and that is disengaged during wind up. The winding handle or crank is disengaged during line release. An anti reverse mechanism is disengaged by a manual, spring loaded pushbutton.

These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
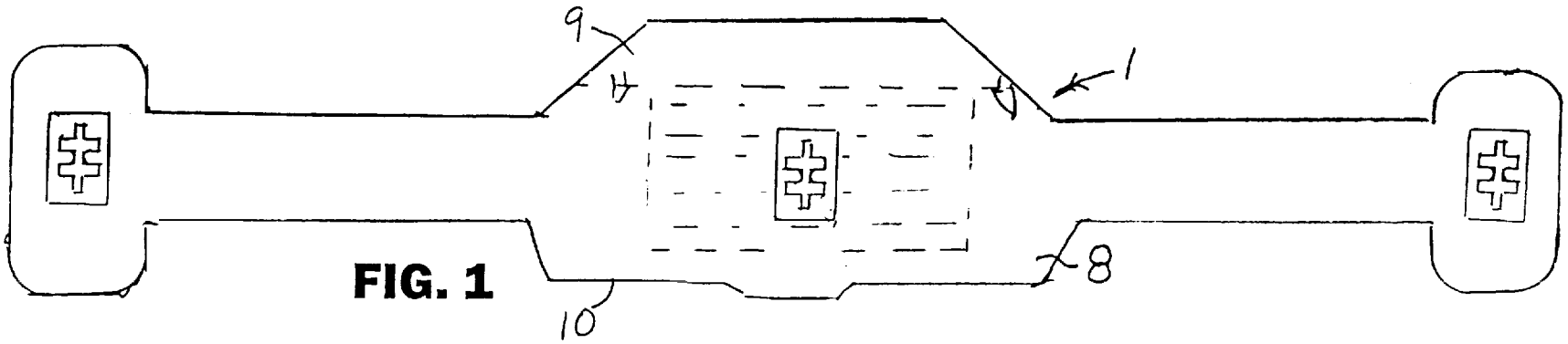
FIG. 1 a top view of the apparatus of the invention, partially broken away.
Figure 3:
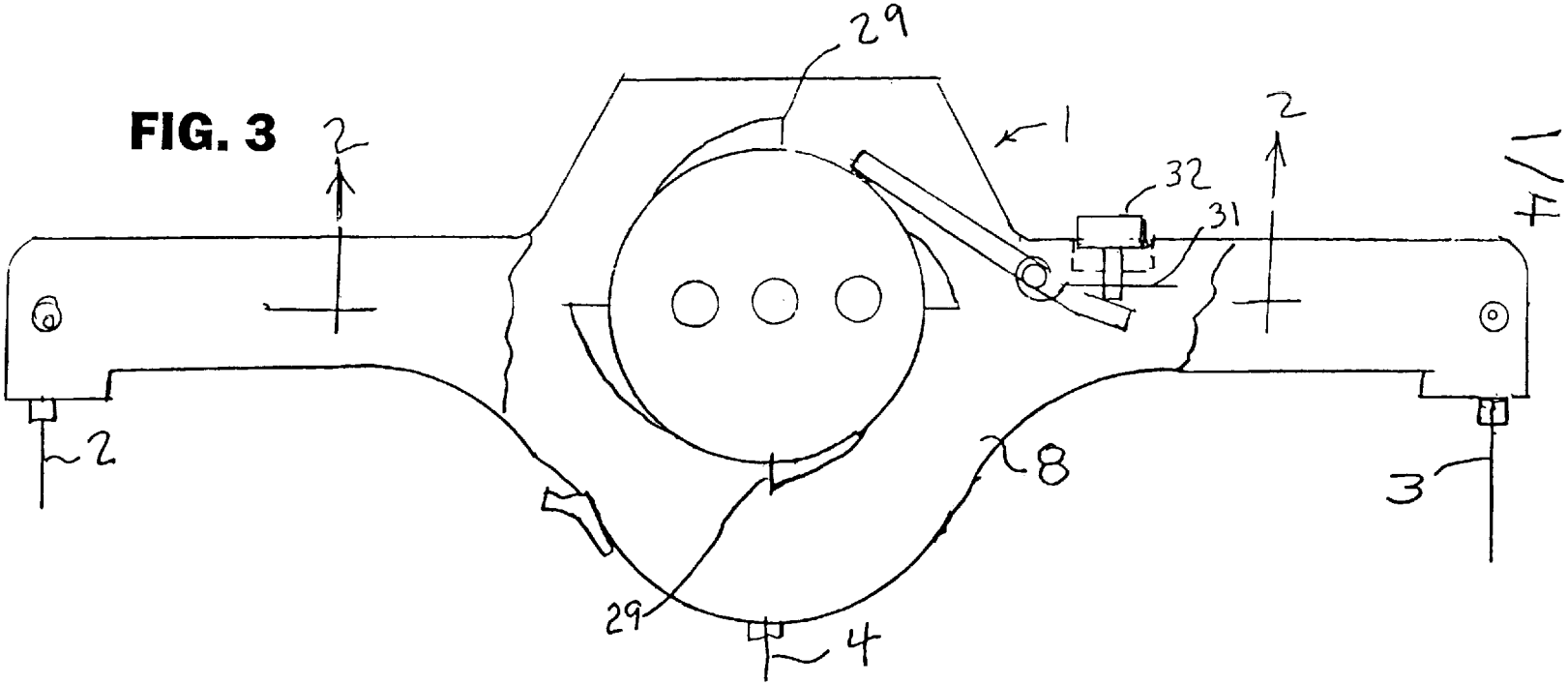
FIG. 3 is side elevation view of the apparatus.
Figure 2:
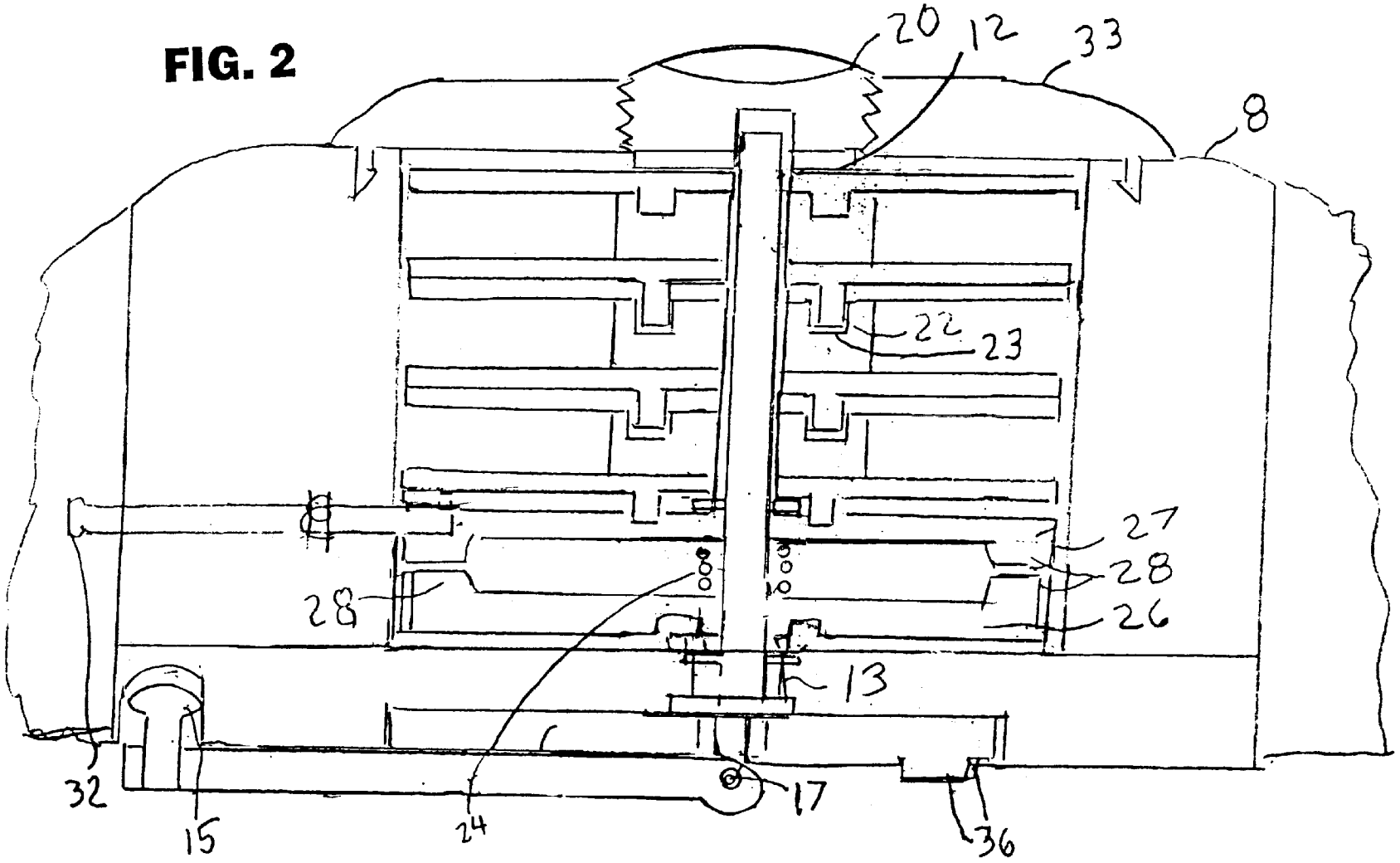
FIG. 2 is a partial sectional view taken on line 2—2 of FIG. 1. with crank in stored position.
Figure 4:
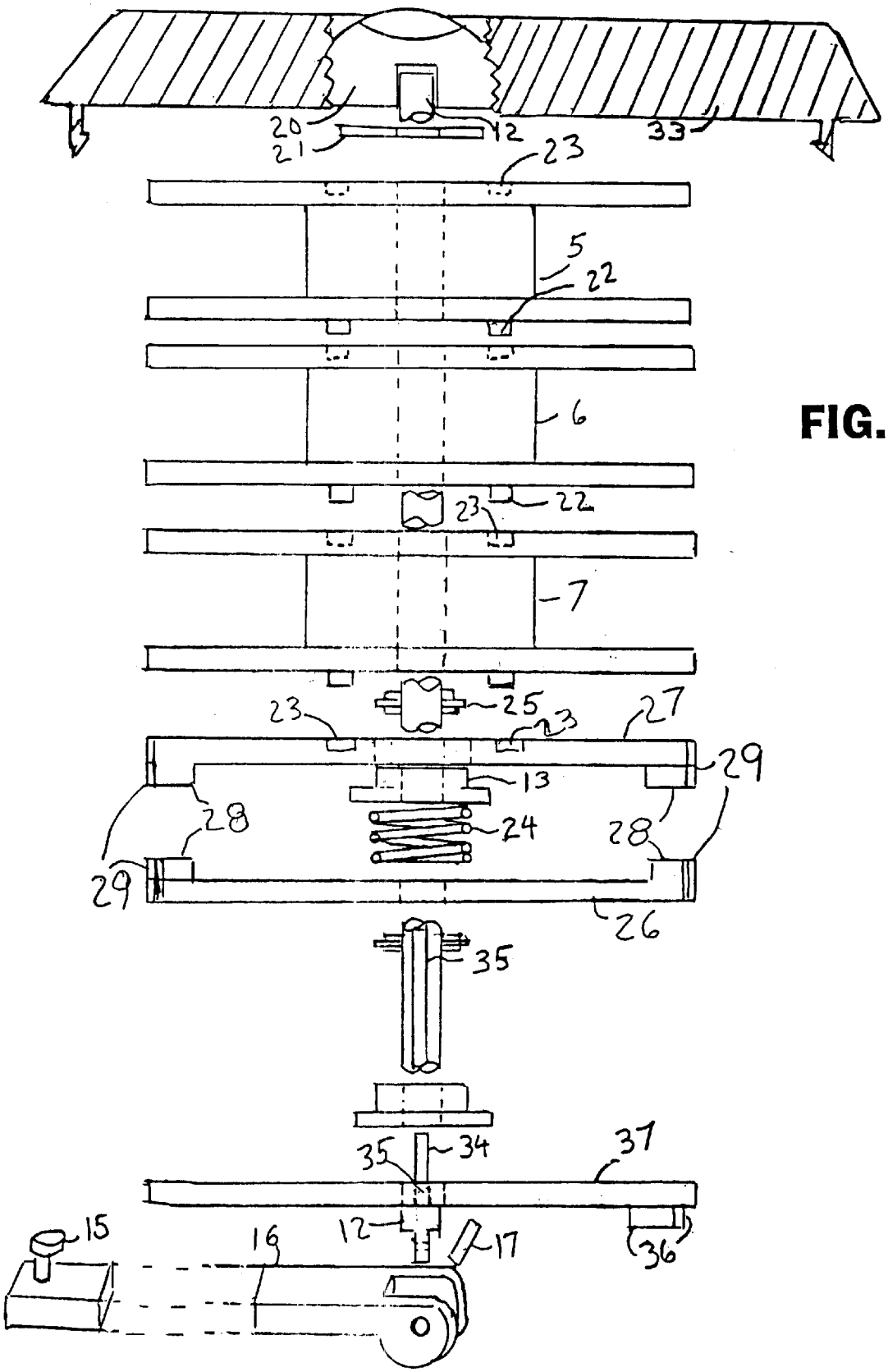
FIG. 4 is an exploded view of FIG. 2.
Figure 5:
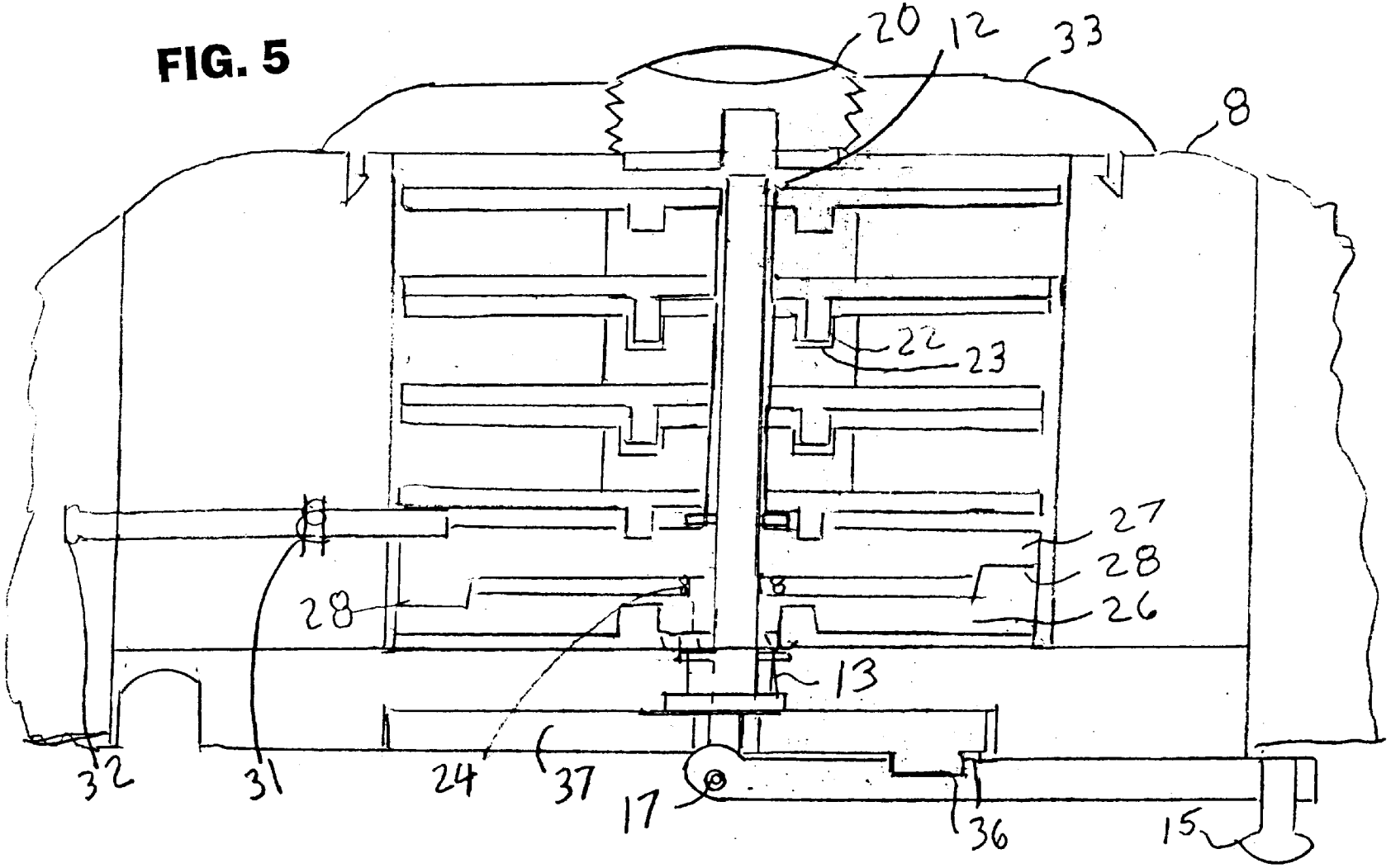
FIG. 5 is a detail as in FIG. 2 with the crank in wind up position.

Referring now to the drawing figures, the apparatus 1 of the invention is a hand-held controller that keeps three kite lines 2,3,4 spaced apart from each other as they exit their spools 5,6,7, so that the kite may be maneuvered by selectively pulling lines by simply moving the housing 8. The spools are received in recess 1 in housing 8. Housing 8 has a front face 9 and a back face 10. Each line leaves its spool and passes around a low friction guide roller 14 located at a different edge of the housing to separate the lines. The spools are rotatably mounted on axle 12. Axle 12 is rotatably mounted on back face 10 by bearing 13 that allows translatory motion of the axle. Each spool has a pin 22 and a pin receiving recess 23, so that the spools, when mounted on the axle, will rotate together. Any spool can be easily removed and replaced, as desired by simply opening the top cover 33. A drag adjusting knob 20 is threadedly mounted in the cover 33. Between the knob 20 and the top spool 5 is a friction washer 21. A compression spring 24 forces the spools against the friction washer. By adjusting the knob, the degree of drag restraining release of line may by preset to avoid backlash and loss of kite control.

Upper gear 27 and lower gear 26 have peripheral teeth 29, and they also have teeth 28 on their faces, which mesh together when juxtaposed. A ratchet pawl 30 is biased by torsion spring 31 to engage the peripheral teeth 29 of the upper gear. This prevents rotation in the line release direction and permits rotation in the wind up direction. A manual release button 32 disengages the pawl to allow rotation of upper gear 27 in line release direction. Recess 23 in the upper gear engages pin 22 in the lowest spool so that the upper gear and spools always rotate together. Thus the upper gear 27 is free to rotate on the axle, and the ratchet prevents spool rotation. The lower gear is fixed to the axle by key 34 in keyway 35. A crank arm 16 with rotatably mounted winding handle 15 is pivotally mounted to the end of axle 12 by an off center pivot pin 17. The crank arm is movable on the pivot pin through 180 degrees between a first, or wind up, position in which the handle is extended for use, and a second, or line release position, in which the handle is recessed.

In the first position, the offsetting of the pivot causes the axle to be pulled down away from the drag washer, thereby removing the drag during wind up. Clamp lock 25 affixed to the axle pulls the upper gear 27 down so that its face teeth 28 mesh with the face teeth 28 of the lower gear 26. Disc 37 is also keyed to the axle. It is provided with a pair of projections 36, between which the crank arm fits. This stabilizes the arm and provides leverage in rotating the axle. Movement of the crank arm now rotates the spools, because the lower gear is attached to the axle and the spools are attached to the upper gear by their pins 22. Because the ratchet is operational, there is no release of line.

In the second, or release, position of the arm, the axle moves upward. The handle is stowed away. The upper and lower gears are no longer meshed, so that the spools are free to rotate on the axle, with two restraints. Because the axle is forced upward by compression spring 24, the drag, or friction, washer is compressed between the drag adjusting knob and the upper spool, thereby adjustably resisting release of line. The ratchet mechanism remains operative, and is removed selectively when the operator presses the manual release button 32. The line is then released under the restraint of the drag.

The above disclosed invention has a number of particular features which should preferably be employed in combination, although each is useful separately without departure from the scope of the invention. While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. Apparatus for dispensing, retracting, and controlling a plurality of lines to a light weight airborne device, the apparatus comprising:

a) A plurality of spools separable from one another, each spool constructed for storing one of said plurality of lines;

b) a housing having a front face and a back face;

c) a recess in the housing open at the front face;

d) an axle rotatably supported on the back face, extending orthogonally therefrom through the recess, and constructed for rotatably mounting the plurality of spools thereon;

e) a plurality of low friction line guides spaced apart from one another, each of said line guides attached to the housing and aligned with one of said spools for guiding a line extending from the spool for spatial control of the device by movement of the housing;

f) a winding handle rotatably mounted on an arm that is pivotally connected to the axle, the arm having two operating positions:

1) a first position for winding line onto the spools in which the handle extends away from the back face and rotates about an axis parallel to, and spaced apart from, the axle; and 2) a second position for releasing line in which the arm is pivoted through an angle of 180 degrees from the first position and the handle extends toward the front face;

g) an adjustable friction drag mechanism for preventing free spool movement and backlash during line release, the drag mechanism being operative in the second position of the arm and inoperative in the first position of the arm;

h) a releasable connecting mechanism connecting the spools to the axle in the first position of the arm and disconnecting the spools from the axle in the second position of the arm;

i) an anti reverse ratchet mechanism operatively connected to the spools for permitting rotation of the spools in a first direction for winding line and preventing rotation of the spools in a second direction for releasing line; and j) a manual release operatively connected to the ratchet mechanism to disable the ratchet mechanism and permit rotation in the second direction for release of line.

2. The apparatus according to claim 1, in which there are two spools and lines.

3. The apparatus according to claim 1, in which there are three spools and lines.

4. The apparatus according to claim 1, in which there are four spools and lines.

5. The apparatus according to claim 1, in which the manual release is spring biased.

6. The apparatus according to claim 1, in which movement of the arm from the second to the first positions translates the axle away from the front face against a spring bias.

7. The apparatus according to claim 6, in which the drag mechanism is mounted in the front face.

8. The apparatus according to claim 1, in which the drag mechanism is mounted in the front face.

9. The apparatus according to claim 8, in which the line guides are rollers.

10. The apparatus according to claim 1, in which the line guides are rollers.

11. The apparatus according to claim 1, in which the drag mechanism is mounted in a removable element covering the recess at the front face.

* * * * *